United States Patent [19]

Gillette

[11] 4,288,770

[45] Sep. 8, 1981

[54] THERMAL OVERRIDE FOR STATIC TRIP CIRCUIT BREAKERS

[75] Inventor: Stephen F. Gillette, Rocky Hill, Conn.

[73] Assignee: General Electric Company, New York, N.Y.

[21] Appl. No.: 98,097

[22] Filed: Nov. 28, 1979

[51] Int. Cl.[3] ..... H01H 9/00

[52] U.S. Cl. ..... 335/173; 337/54; 335/145

[58] Field of Search ..... 337/54; 335/141, 145, 335/172, 173, 174, 78, 80, 179, 229

[56] References Cited

U.S. PATENT DOCUMENTS

| | | | |
|---|---|---|---|
| 2,335,888 | 12/1943 | Stilwell, Jr. | 335/145 |
| 2,358,357 | 9/1944 | Stilwell, Jr. | 335/145 X |
| 2,482,955 | 9/1949 | Wilson | 335/145 X |
| 3,103,563 | 9/1963 | Grenier | 335/145 |
| 3,728,658 | 4/1973 | Kasahara | 335/145 X |

*Primary Examiner*—George Harris

*Attorney, Agent, or Firm*—Robert A. Cahill; Walter C. Bernkopf; Philip L. Schlamp

[57] ABSTRACT

A flux shifting type trip device, which is electrically activated under the control of a static trip unit to mechanically initiate tripping of a circuit breaker automatically in response to an abnormal current condition in a protected circuit, is equipped with a thermal responsive element operative to directly, mechanically activate the trip device and thereby initiate circuit breaker tripping automatically in response to an excessive ambient temperature condition within the circuit breaker enclosure.

10 Claims, 4 Drawing Figures

FIG. 1
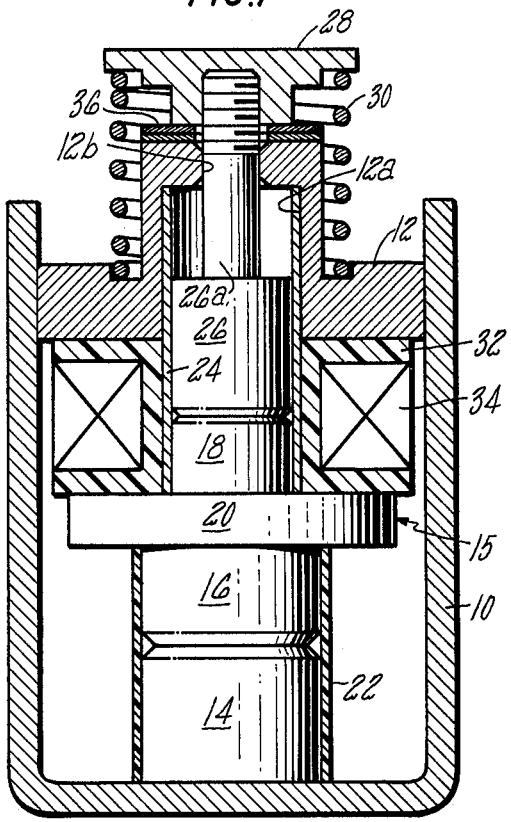
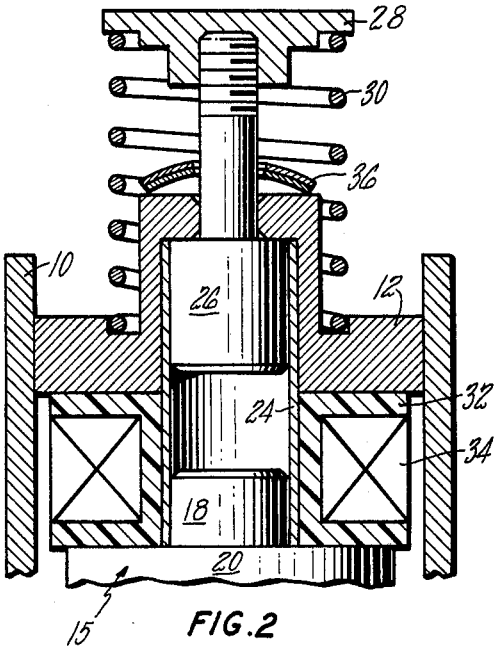
FIG. 2
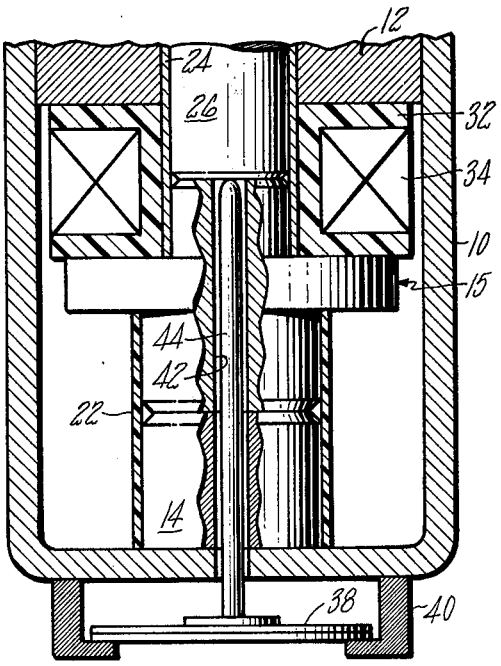
FIG. 3
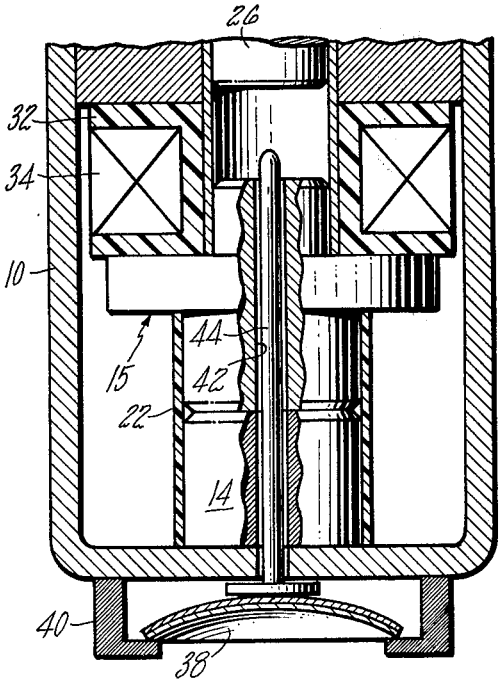
FIG. 4

THERMAL OVERRIDE FOR STATIC TRIP CIRCUIT BREAKERS

BACKGROUND OF THE INVENTION

The present invention relates to industrial circuit breakers and particularly to a trip initiating thermal override for molded case industrial circuit breakers equipped with static (solid state) trip units.

It is known that a molded case circuit breaker can develop an excessive internal ambient temperature condition even when conducting current well within its current rating. This overheating condition is caused by abnormal losses in the breaker current paths typically occasioned by poor electrical connections or deteriorated breaker contacts.

Circuit beakers equipped with traditional thermal or thermal-magnetic trip units are afforded a reasonable measure of protection against a self-destructive thermal runaway condition since the current heating of the thermally responsive trip element, typically a bimetal, subjected to a rising ambient temperature environment will eventually precipitate tripping of the circuit breaker. Unfortunately, static trip units, now being increasingly implemented in industrial molded case circuit breakers, only respond to the currents flowing in the breaker poles and thus, unlike thermal and thermal-magnetic trip units, are not normally responsive to internal ambient temperature. To afford ambient temperature responsiveness, it is known to equip a static trip unit with a temperature sensor, such as a thermistor, operative to produce a trip signal when overheating occurs. However, this approach to thermal protection relies on the continued operability of the static trip unit whose electronic components are particularly susceptible to damage by high ambient temperatures. Thus any appreciable time lag in the temperature sensor's response can render the static trip unit totally inoperative to initiate tripping of the circuit breaker.

It is accordingly an object of the present invention to provide a direct acting thermal trip override for static trip circuit breakers.

A further object is to provide a thermal trip override of the above character which utilizes a thermal-mechanical element responsive to the ambient temperature within a circuit breaker enclosure.

An additional object is to provide a thermal override of the above character wherein the thermal-mechanical element operates independently of the trip unit electronics to reliably initiate tripping of a circuit breaker automatically in response to the ambient temperature exceeding a safe level.

Yet another object is to provide a thermal trip override of the above character wherein the thermal-mechanical element is incorporated in and operative to initiate thermal override circuit breaker tripping action of an electro-mechanical, flux shifting trip device otherwise electrically activated under the control of a static trip unit to initiate a circuit protective trip function.

Other objects of the invention will in part be obvious and in part appear hereinafter.

SUMMARY OF THE INVENTION

In accordance with the present invention, there is provided a thermal override for protecting a molded case static trip circuit breaker from the damaging consequences of over-heating by initiating a circuit breaker trip function in direct acting fashion automatically in response to an abnormal rise in the internal ambient temperature. Pursuant to a signal feature of the invention, the thermal override is incorporated in an electro-mechanical tripping device normally operative to trip the circuit breaker in response to electrical energization under the control of the static trip unit when an over-current condition in the protected circuit is detected. Such electromechanical trip devices are of known construction comprising a plunger which is normally held in a retracted position against the bias of a spring by the holding flux developed by a permanent magnet. To electrically initiate a trip function, the device is equipped with an electromagnet which is energized by a short current pulse to momentarily develop flux in opposition to the holding flux, leaving a diminished magnetic holding force which the spring can overpower. The plunger is thus propelled by the spring to an extended position, in process striking a latch to release the breaker operating mechanism, and the mechanism spring discharges to propel the breaker contacts to an open circuit position culminating a trip function. Such circuit breaker tripping devices are known in the art as flux shifting or flux transfer devices.

In accordance with the present invention, a thermal-mechanical element is incorporated in a flux shifting device to exert a force on the plunger aiding the spring force and thus opposing the permanent magnet holding force in response to an abnormally high internal ambient temperature condition. When these combined forces exceed the magnet holding force, the plunger is propelled by the spring into trip initiating impact with the circuit breaker latch, and the circuit breaker is tripped to interrupt current flow therethrough. The source of the heat is thus removed before thermal damage to the circuit breaker is inflicted.

As an additional feature of the invention, the thermal-mechanical element resists attempts to fully return the plunger to its retracted position while the high ambient temperature condition persists, and thus the circuit breaker can not be reclosed until the ambient temperature has fallen to a safe level.

The invention accordingly comprises the features of construction and arrangement of parts which will be exemplified in the constructions hereinafter set forth, and the scope of the invention will be indicated in the claims.

For a better understanding of the nature and objects of the invention, reference should be had to the following detailed description taken in conjunction with the accompanying drawings, in which:

FIG. 1 is a longitudinal sectional view of a circuit breaker electro-mechanical, flux shifting trip device incorporating a thermal trip override in accordance with one embodiment of the present invention;

FIG. 2 is a fragmentary longitudinal sectional view of the trip device of FIG. 1 illustrating the operation of the thermal trip override in effecting tripping action of the trip device;

FIG. 3 is a fragmentary longitudinal sectional view of the trip device of FIG. 1 incorporating an alternative thermal trip override embodiment of the present invention; and FIG. 4 is a fragmentary longitudinal sectional view of the trip device of FIG. 1 illustrating the trip initiating operation of the thermal trip override embodiment of FIG. 3.

Corresponding reference numerals refer to like parts throughout the several views of the drawing.

DETAILED DESCRIPTION

Referring to FIG. 1, the thermal override of the present invention is incorporated in a circuit breaker flux shifting trip device comprising a frame 10 formed of a highly magnetically permeable material. The open end of the frame is provided with an endwall 12 also of magnetically permeable material. Secured in flux coupled relation with the closed endwall of the frame is a permanent magnet 14 which may be formed of a cobalt-rare earth material, such as cobalt-samarium. As disclosed in commonly assigned U.S. Pat. No. 3,671,893, cobalt-rare earth magnets have a high coercive force and are exceptionally resistant to demagnetization. A flux diverter, generally indicated at 15, is integrally formed to provide pole pieces 16 and 18 projecting from opposed sides of a larger diameter flange 20 whose periphery is disposed in closed proximity to the frame. For a discussion of the function of a flux diverter in a flux shifting trip device, reference may be had to commonly assigned U.S. Pat. No. 3,693,122.

Still referring to FIG. 1, diverter pole piece 16 is disposed in abutting relation with permanent magnet 14. An insulative sleeve 22 embraces the magnet and pole piece 16 to maintain them in concentric relation. Diverter pole piece 18 is embraced by a brass sleeve 24 which extends upwardly into close fitting relation with a countersunk hole 12*a* in endwall 12. This brass sleeve, in addition to cooperating with insulative sleeve 22 in maintaining the concentric positionings of the parts, provided a smooth, non-binding bore reciprocally mounting a plunger 26 having a stem 26*a* extending upwardly through a central hole 12*b* in endwall 12. The terminal portion of stem 26*a* is threaded to receive a cap 28. A helical compression spring 30, captured between the cap and endwall 12, biases the plunger to its extended position seen in FIG. 2. The portion of the brass sleeve intermediate endwall 12 and flux diverter flange 20 is embraced by a bobbin 32 of non-magnetic material on which is wound a coil 34 to provide an electromagnet for effecting electrical actuation of the flux shifting trip device.

In accordance with the well-understood operation of a flux shifting device, as long as the plunger is firmly seated against diverter pole piece 18 in a retracted position, the permanent magnet holding flux flowing in the looped path including the magnet, flux diverter, plunger, endwall and frame develops sufficient magnetic force holding the plunger in its retracted, seated position against the force of spring 30 biasing the plunger to its extended position. When coil 34 is energized with a current pulse originated by an overcurrent or ground fault responsive static trip unit, the resulting electromagnet flux opposes the permanent magnet flux such that the net holding flux flowing through the plunger is momentarily diminished to the extent that spring 30 becomes overpowering. This spring is thus empowered to propel the plunger to its extended position of FIG. 2, in the process striking a circuit breaker latch (not shown) to initiate tripping of the circuit breaker.

To adapt the above-described flux shifting trip device to also function as a thermal override trip device affording thermal protection to the circuit breaker in which it is installed, a thermal-mechanical element is so incorporated that its mechanical response to a high ambient temperature condition acts to exert a force on the plunger aiding the spring force and opposing the permanent magnet holding force. When these combined forces overpower the magnetic holding force, the plunger is propelled by the spring to its extended position tripping the circuit breaker. In the embodiment of the invention seen in FIGS. 1 and 2, this temperature responsive element is in the form of a bimetallic washer 36 which is inserted on plunger stem 26*a* to occupy a position between endwall 12 and cap 28. As long as the ambient temperature in the circuit breaker enclosure is within safe limits, the bimetallic washer remains in the essentially planar configuration seen in FIG. 1. However, when the ambient temperature exceeds an acceptable level, the bimetallic washer assumes a bevelled or concavo-convex configuration seen in FIG. 2, in the process exerting a force on the plunger aiding the spring in overpowering the permanent magnet holding force.

Preferably, washer 36 is of the snap-acting type in that it rather abruptly converts from its planar configuration to its bevelled configuration as the ambient temperature rises through a threshold level marking the boundary between safe and unsafe ambient temperature conditions.

In the embodiment of the invention seen in FIGS. 3 and 4, the thermal-mechanical element is in the form of a bimetallic disc 38 mounted by a suitable bracket 40 beyond the closed end of frame 10. An axial bore 42 is formed in flux diverter 15, permanent magnet 14 and the frame to receive a rod 44 of a length slightly less than the distance between bimetallic disc 38 in its planar configuration of FIG. 3 and plunger 26 in its retracted position seated against the diverter pole piece. As in the embodiment of FIGS. 1 and 2, when the ambient temperature rises above a safe level, bimetallic disc 38 assumes its bevelled configuration of FIG. 4, in the process pushing rod 44 upwardly to exert a force on the plunger in opposition to the magnet holding force. Spring 30 is then empowered to propel the plunger out to its fully extended position tripping the circuit breaker. Again, disc 38 is preferably of the snap-acting type.

It will be noted in both disclosed embodiments of the invention that until the ambient temperature falls into the safe region and the temperature responsive bimetallic element reverts to its planar configuration, attempts to physically reseat the plunger are resisted. Consequently, the circuit breaker can not be reclosed until the abnormal ambient temperature condition has subsided. It will be appreciated that the teachings of the present invention can be utilized to provide a circuit breaker trip device functioning exclusively as a thermal trip override. That is, the trip device need not also be electrically actuable, and thus the electromagnet in the disclosed embodiments may be omitted.

It will thus be seen that the objects set forth above, among those made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described my invention, what I claim as new and desire to secure by Letters Patent is:

1. For incorporation in an electromechanical trip device including a permanent magnet for developing a holding flux to create a magnetic force on a plunger sufficient to hold the plunger in a retracted position against the bias of a spring and an electromagnet for selective electrical energization to develop flux in opposition to the holding flux, whereby the magnetic holding force on the plunger is diminished to the extent that the spring becomes overpowering, whereupon the plunger is propelled by the spring to an extended circuit breaker trip initiating position, a thermal trip override comprising a thermal-mechanical element acting to exert a force on the plunger aiding the spring force such as to overpower the magnetic holding force when the temperature becomes excessive whereupon the plunger is propelled to its extended, circuit breaker trip initiating position by the spring.

2. The thermal trip override defined in claim 1, wherein said thermal-mechanical element is a bimetallic element.

3. The thermal trip override defined in claim 1, wherein said thermal-mechanical element further acts to prevent the plunger from being fully returned to its retracted position until the excessive temperature condition has subsided.

4. The thermal trip override defined in claim 2, wherein said bimetallic element is of the snap-acting type acting to rather abruptly convert from a normal configuration to distorted configuration as the temperature rises through a threshold level, in the process of this conversion, said bimetallic element exerting its spring-aiding force on the plunger.

5. The thermal trip override defined in claim 4, wherein said bimetallic element in its distorted configuration prevents the plunger from being fully returned to its retracted position, said bimetallic element converting back to its normal configuration when the temperature drops below the threshold level to permit the full return of the plunger to its retracted position.

6. The thermal trip override defined in claim 5, wherein said bimetallic element is in the form of a disc having a normal planar configuration and a distorted, concavo-convex configuration assumed in response to the temperature rising through the threshold level.

7. The thermal trip override defined in claim 6, wherein said disc is formed having a central opening through which the plunger extends, and said disc exerting its spring-aiding force on an external beaded portion of the plunger.

8. The thermal trip override defined in claim 6, wherein said disc exerts its spring-aiding force on the inner end of the plunger via an intermediate push rod.

9. A thermal trip override device operative to trip a circuit breaker in response to a high ambient temperature within the circuit breaker enclosure, said device comprising, in combination:

A. a plunger of high magnetically permeable material mounted for movement between a retracted position and an extended position;

B. a spring biasing said plunger to its extended position effective in initiating tripping of the circuit breaker;

C. a permanent magnet for developing holding flux flowing in a magnetic circuit including said plunger, said holding flux developing sufficient magnetic force to hold said plunger in its retracted position against the bias of said spring; and D. temperature responsive means acting in response to a high ambient temperature condition within the breaker enclosure to exert a force on said plunger aiding said spring whereby the magnetic force on said plunger is overpowered, enabling said spring to propel said plunger to its extended position.

10. The thermal trip override defined in claim 9, which further includes an electromagnet electrically energizable to develop flux in said magnetic circuit opposing the holding flux, whereby to reduce the magnetic holding force on said plunger to the extent that said spring becomes overpowering.

* * * * *